US006039329A

United States Patent [19]

Burns et al.

[11] Patent Number: 6,039,329

[45] Date of Patent: Mar. 21, 2000

[54] ROLLER SKATE SHOCK ABSORBER SYSTEM

[75] Inventors: Clay Allen Burns, Boston; Peter Madelaire Nielsen, Quincy; John Aloysius Sullivan; Frederic Ballou-Viaux Sullivan, both of Wayland, all of Mass.

[73] Assignee: Evolutionary Designs, Inc., Wayland, Mass.

[21] Appl. No.: 08/889,828

[22] Filed: Jul. 10, 1997

Related U.S. Application Data

[63] Continuation-in-part of application No. 08/984,187, Jan. 11, 1996, Pat. No. 5,823,543.

[51] Int. Cl.[7] ..... A63C 17/02

[52] U.S. Cl. ..... 280/11.19; 280/11.22; 280/11.28

[58] Field of Search ..... 280/11.19, 11.22, 280/11.23, 11.27, 11.28; 188/5, 6, 7

[56] References Cited

U.S. PATENT DOCUMENTS

| | | | |
|---|---|---|---|
| 5,405,156 | 4/1995 | Gonella | 280/11.28 |
| 5,582,418 | 12/1996 | Closser | 280/11.22 |
| 5,676,218 | 10/1997 | Hirose | 280/11.27 |
| 5,704,621 | 1/1998 | Lazarevich et al. | 280/11.28 |
| 5,791,665 | 8/1998 | Mayer, II | 280/11.22 |
| 5,823,543 | 10/1998 | Burns et al. | 280/11.22 |

*Primary Examiner*—Paul N. Dickson
*Assistant Examiner*—Bridget Avery
*Attorney, Agent, or Firm*—Iandiorio & Teska

[57] ABSTRACT

A suspension system for a skate including a shoe and a truck device. The suspension system includes a four bar linkage having a forward mount connectable to the shoe; a rearward mount connectable to the shoe, a first double pivot mechanism interconnecting the forward mount with the truck device, and a second double pivot mechanism interconnecting the rearward mount with the truck device. A shock absorber subsystem biases the position of the truck device relative to the shoe.

44 Claims, 5 Drawing Sheets

ROLLER SKATE SHOCK ABSORBER SYSTEM

RELATED APPLICATION

This application is a Continuation-in-Part application of U.S. patent Ser. No. 08/584,187 filed Jan. 11, 1996, now U.S. Pat. No. 5,823,543.

FIELD OF INVENTION

This invention relates to a roller skate shock absorber system, and more particularly to such a system which provides for both a stiff push off force and also resilient shock absorption.

BACKGROUND OF INVENTION

As roller skating with both double wheel and in-line skates has become more popular as an exercise, as a fun sport and even for commuting, the need for a more versatile suspension system has grown and intensified. The growth of the in-line skate market has accelerated this need. In-line skates enable and encourage faster and more challenging skating. In many areas, it is difficult to find a smooth skatable route which is long enough to satisfy an enthusiastic skater. Thus, skaters tend to endure rough roads and even to go off-road trail blazing to find the desired distance and challenge. Whether on rough roads or trail blazing, the rough bumpy terrain can be punishing to the skater's muscles and joints, and dangerous too. While attempts have been made to soften the bumps, especially in in-line skates, using softer wheels, springs and the like, no suitable solution has been provided. This problem presents a dilemma. If the suspension is soft or springy enough to absorb shocks, then it tends to be too soft or sloppy in the push-off mode and if the suspension is stiff enough to enable efficient transfer of push-off force, then shock absorption is poor. In many cases, the resilience in the suspension is provided by simple springs which do not truly absorb the shocks encountered on rough routes. A serious shortcoming of present skates is that they do not absorb well shocks from all directions—front, angled, and vertical, all of which can be encountered on rough and bumpy roads.

SUMMARY OF INVENTION

It is therefore an object of this invention to provide an improved roller skate shock absorber system which is both stiff for push-off and resilient for shock absorption.

It is a further object of this invention to provide such a roller skate shock absorber system which is inexpensive and simple to manufacture and use.

It is a further object of this invention to provide such a roller skate shock absorber system which does not require special skate shoes or wheels.

It is a further object of this invention to provide such a roller skate shock absorber system which performs well on bumpy, loose and soft surfaces.

It is a further object of this invention to provide such a roller skate shock absorber system which absorbs front, angular and vertical impacts.

It is a further object of this invention to provide such a roller skate shock absorber system which is easy to adjust.

This invention results from the realization that a shock absorber system in the form of a four bar linkage biased into position by a shock absorber allows for a firm push-off force at the front of the skate and yet at the same time provides improved overall shock absorption and that a single adjustment mechanism can be used to adjust the stiffness of the shock absorber.

This invention features a suspension system for a skate including a shoe and a truck. Such skates include in-line skates, roller skates, cross-country ski training devices and the like. There is a four bar linkage including a forward mount connectable to the shoe, a rearward mount connectable to the shoe, a first double pivoting mechanism interconnecting the forward mount with the truck device, and a second double pivoting mechanism interconnecting the reward mount with the truck device. There are also means for biasing the truck device with respect to the shoe.

The first double pivot mechanism typically includes a member pivotably attached on one end to the forward mount and pivotably attached on the other end to the truck device. The second double pivot mechanism typically includes a member pivotably attached on one end to the rearward mount and pivotably attached on the other end to the truck device.

The means for biasing preferably includes a shock absorber subsystem pivotably attached on one end to the truck device and pivotably attached on the other end to the shoe. The shock absorption system may be attached to the shoe via the rearward mount. The shock absorber subsystem comprises a first shaft pivotably attached to the truck device, a second shaft pivotably attached to the shoe, and a resilient member disposed to bias the position of the first shaft relative to the position of the second shaft. The resilient member is usually disposed about the first shaft. The second shaft includes an orifice for slidably receiving the first shaft. The second shaft also includes an adjustment mechanism for adjusting the position of the first shaft relative to the second shaft. This adjustment mechanism may include a housing and bolt receivable in the housing. The housing is pivotably connected to the shoe via the rearward mount. The bolt includes a head engaged with the resilient member for simultaneously adjusting the resiliency of the resilient member and the position of the truck device with respect to the skate shoe.

The means for biasing may include a shock absorber subsystem pivotably attached on one end to the truck device and pivotably attached on the other end to the shoe, the shock absorber system including a resilient member and means for adjusting the resiliency of the resilient member. The means for adjusting comprises a first shaft pivotably attached to the truck device and a second shaft pivotably attached to the shoe, the resilient member disposed to bias the position of the first shaft relative to the position of the second shaft.

The first double pivoting mechanism includes first pivot means proximate the forward mount and second pivot means proximate the truck device, the first and second pivot means disposed generally one on top of the other and generally vertically aligned to provide decreased vertical resiliency for the forward push-off portion of the skate. There may be means for adjusting the vertical alignment of first and second pivot means between 0 and 25°. The second double pivot mechanism includes third pivot means proximate the rearward mount and fourth pivot means proximate the truck device. The third and fourth pivot means are disposed generally not one on top of the other and not generally vertically aligned to provide increased vertical resiliency for the rearward shock absorbing portion of the skate. The vertical alignment of the third and fourth pivot means is normally between 30° and 50°.

There is also a brake device removably attached to the truck device. Finally, there are means for releasably locking the position of the shock absorber subsystem. The front and rear mounts may be separate or portions of a single rigid plate.

DISCLOSURE OF PREFERRED EMBODIMENT

Other objects, features and advantages will occur to those skilled in the art from the following description of a preferred embodiment and the accompanying drawings, in which.

Figure 1:
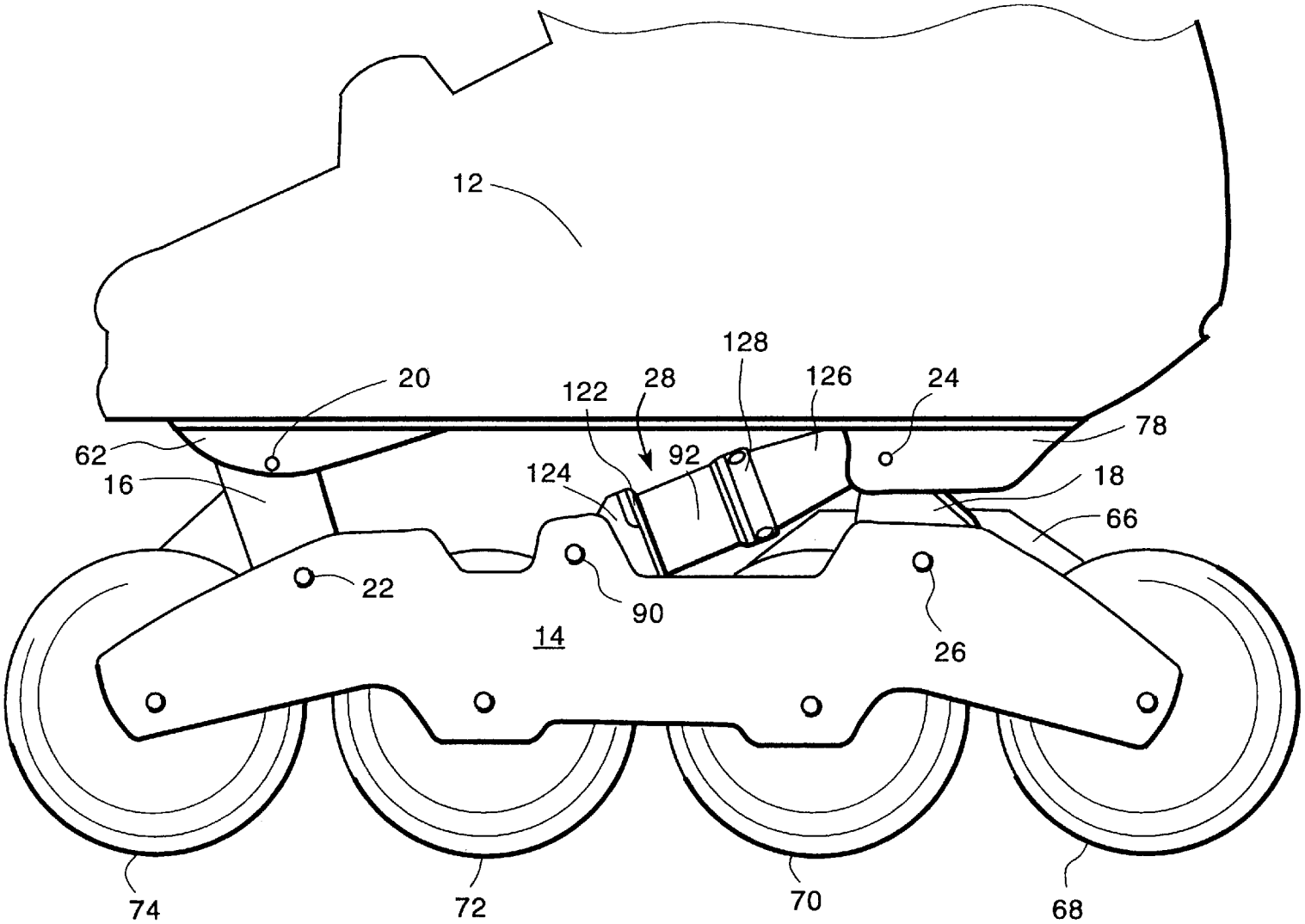
FIG. 1 is a side elevational diagrammatic view of the suspension system of this invention.

The suspension system of this invention includes a four bar linkage made up of a typical skate shoe 12 and skate truck 14, first, forward double pivoting member 16 extending between skate shoe 12 and truck device 14, and second, rearward double pivoting member 18 also extending between skate shoe 12 and truck device 14. First double pivoting member 16 includes first pivot means in the form of shaft 20 and second pivot means in the form of shaft 22. Second double pivoting member 18 includes third and fourth pivot means in the form of shafts 24 and 26, respectively. Shaft 20 pivotably interconnects member 16 with forward shoe mount 62 and shaft 22 pivotably interconnects member 16 with truck 14 between sidewalls 64 and 66 separated by a plurality of in-line wheels 68, 70, 72, and 74 each on axles spanning between sidewalls 64 and 66. Shaft 24 pivotably interconnects rear member 18 with rear shoe mount 78 and shaft 26 pivotably interconnects member 18 with truck device 14. The suspension system of this invention also includes some means for biasing the four-bar linkage and truck device 14 into one or more positions with respect to skate shoe 12 such as shock absorber subsystem 28 extending between pivot point 24 on skate shoe 12 and pivot point 30 on truck device 14. As shown in phantom at 28' and 28", FIG. 2, however, shock absorber subsystem 28 may interconnect shoe 12 and truck device 14 (shock absorber subsystem 28') or, alternatively, interconnect pivot point 30 and member 18 (shock absorber subsystem 28"), or may extend between any two links, any two pivot points, or a pivot point and a link. Thus, the shock absorber subsystem, depending on where it is placed, can be used to modify the height of the skate shoe and/or to change the appearance of the skate.

In the preferred embodiment, first and second pivot means 20 and 22 are disposed generally one on top of the other and generally vertically aligned as shown to provide decreased vertical resiliency for the forward portion of the skate shoe thus allowing for a firm push-off by the wearer of the skate. Because of this vertical or near vertical alignment, (i.e. somewhere between 0 and 25°), the resiliency in the direction of vertical vector 40 is decreased and yet four bar linkage 10 in combination with shock absorber subsystem 28 provides adequate resiliency in all other directions schematically shown by vector 42 to absorb shocks which occur because of uneven surfaces. Also in the preferred embodiment, pivot points 24 and 26 of rearward member 18 are not generally vertically aligned one on top of the other, (i.e. somewhere between 30–50°), thus providing increased vertical resiliency in the rearward portion of the skate as shown by vector 44 while at the same time providing adequate shock absorbing characteristics in all other directions schematically shown by vector 46.

Figure 2:
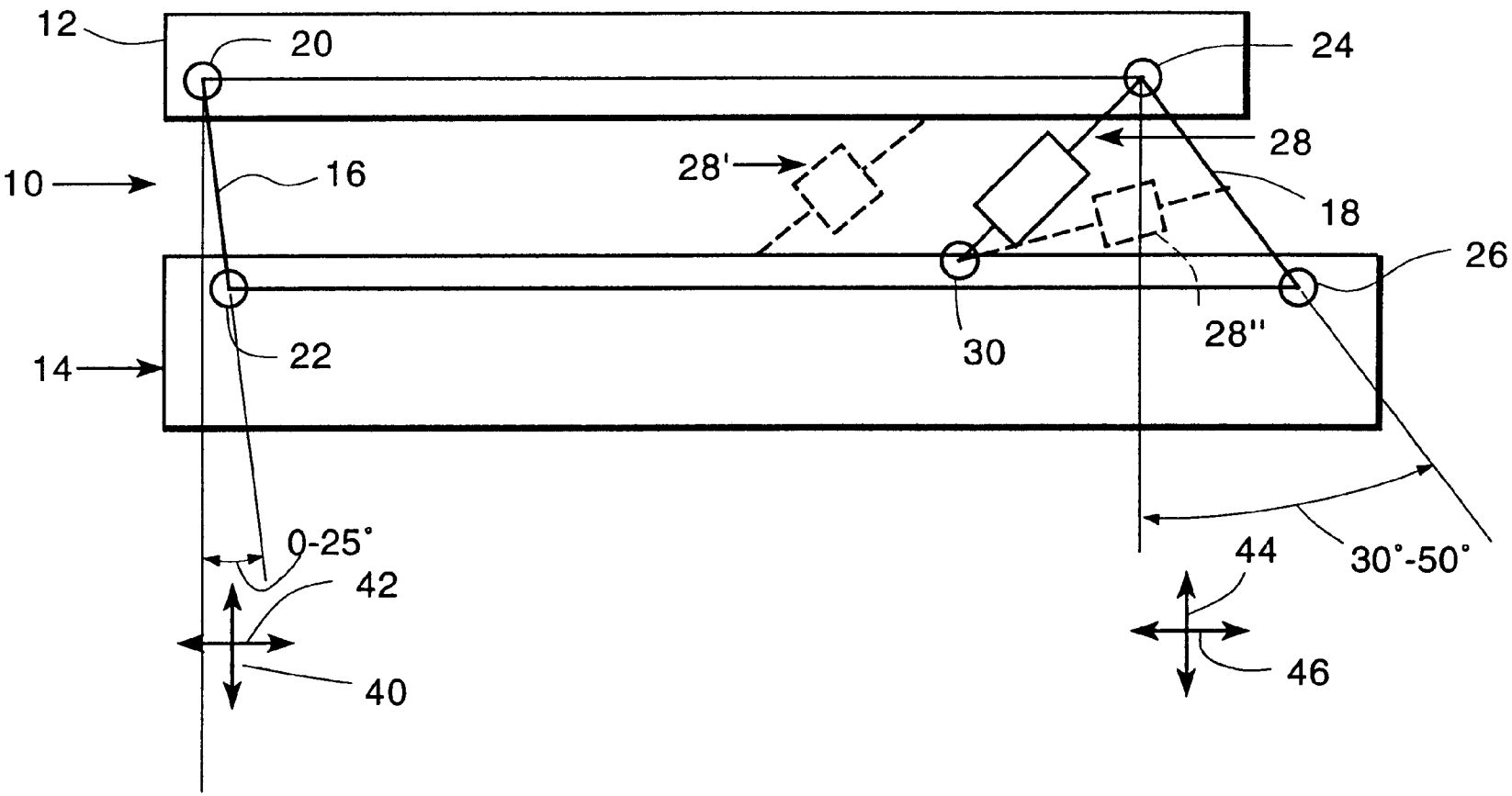
FIG. 2 is a schematic diagram of the suspension system of this invention.

Shock absorber subsystem 28 biases truck device 14 into the position shown in FIGS. 1 and 2 with respect to skate shoe 12. Shock absorber subsystem 28, FIG. 3 includes shafts 120 and 126. Shaft 120 includes lower shock absorber mount 124 pivotably secured to truck 14 via shaft 90. Lower shock absorber mount 124 includes socket 122. Shaft 126 includes housing 127 pivotably attached to rear mount 78 via shaft 24 and hollow bolt 130 threadably received in housing 127. Hollow bolt 130 includes adjustment head 127 and shaft 120 is slidably received within hollow bolt 130. Resilient member 92, FIG. 1, resides on shaft 120, FIG. 3 and extends between socket 122 of lower shock absorber mount 124 and head 127 of hollow bolt 130. Resilient member 92 is conveniently replaced or exchanged with another resilient member of different resilience, color, shape, length, or material simply by disconnecting upper pivot 20 from plate 140 and allowing shaft 120 to slide out of bolt 130. Head 128 is engaged with resilient member 92 as shown in FIG. 1 for adjusting the resiliency of resilient member 92 by varying the position of shaft 120, FIG. 3 within hollow bolt 130 and housing 126 in the direction of arrow 129.

Figure 3:
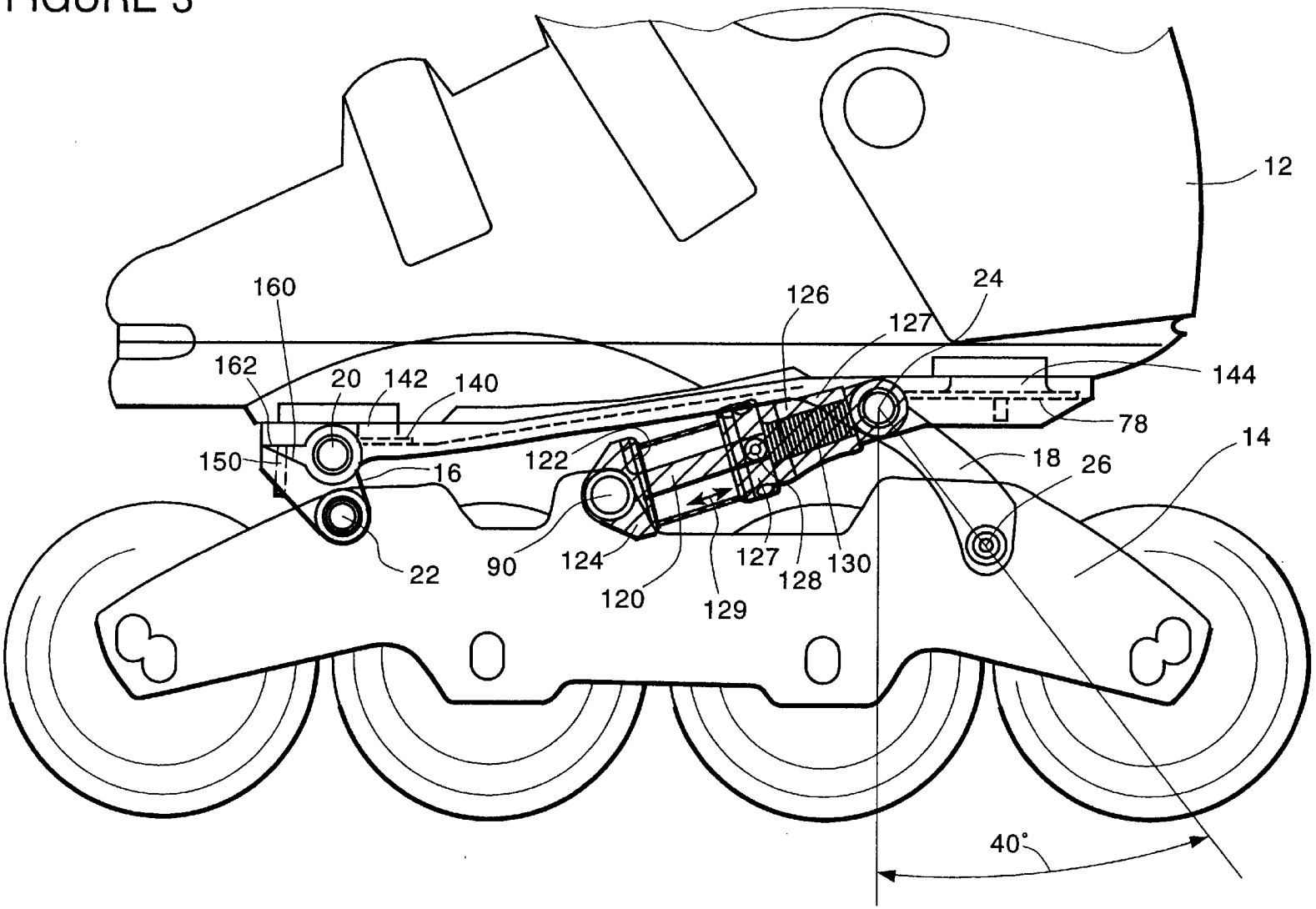
FIG. 3 is side elevational diagrammatic view of another embodiment of the suspension system of this invention showing in cross-section the shock absorber subsystem of this invention.

Plate 140 secures the relative location of upper pivots 20 and 24 independent of the skate shoe and provides additional stiffness for the entire skate in the case where skate shoe 12 has a relatively flexible sole portion. Also shown in FIG. 3 is single rigid plate 140 with front 142 and rear 144 mount portions.

In the preferred embodiment, there is only the single shock absorber for minimizing the number of components of the suspension system thus lowering the manufacturing cost. Set screw 150 is used to adjust the vertical alignment of forward pivot points 20 and 22. As head of set screw 150, FIG. 3 is turned counter clockwise, the angle between pivot points 20 and 22 at the forward portion of the suspension system is decreased thus providing for a firmer push-off force. This angle may be between 0 and 25 degrees. At the same time, the stiffness of resilient member 92 may be increased by turning head 128 of bolt 130. Such a position of truck 14 with respect to skate shoe 12 could be used in conditions where shock absorption is not critical, for example, on city sidewalks or on other paved or smooth surfaces. In these conditions, speed is usually the primary requirement and thus a firm forward push-off force is desirable. Rotating set screw 150 clockwise, however, increases the angle between pivot points 20 and 22 at the forward portion of the skate and rotating head 128 of bolt 130 in the other direction decreases the stiffness of resilient member 92 thus providing for increased shock absorption of the suspension system for conditions where an ultra-firm push-off force is not as critical and shock absorption is the overall consideration. Such conditions include off-road use and skating over irregular surfaces. The user tailors the shock absorption and push-off characteristics of the skate according to the users weight, skating ability, and the terrain. Truck 14 thus absorbs impacts by traveling up and down and/or in an arc like fashion relative to shoe 12. The unique four-bar linkage truck of the subject invention also allows for easier turning and braking. Again, the user tailors the resiliency of member 92 and the angle between the pivot points to suit the skater's requirements. Fasteners such as allen head set screw 127, FIG. 3, provide a means for securing bolt head 128 to shaft 120 to prevent inadvertent turning of bolt head 128 during use.

Figure 4:
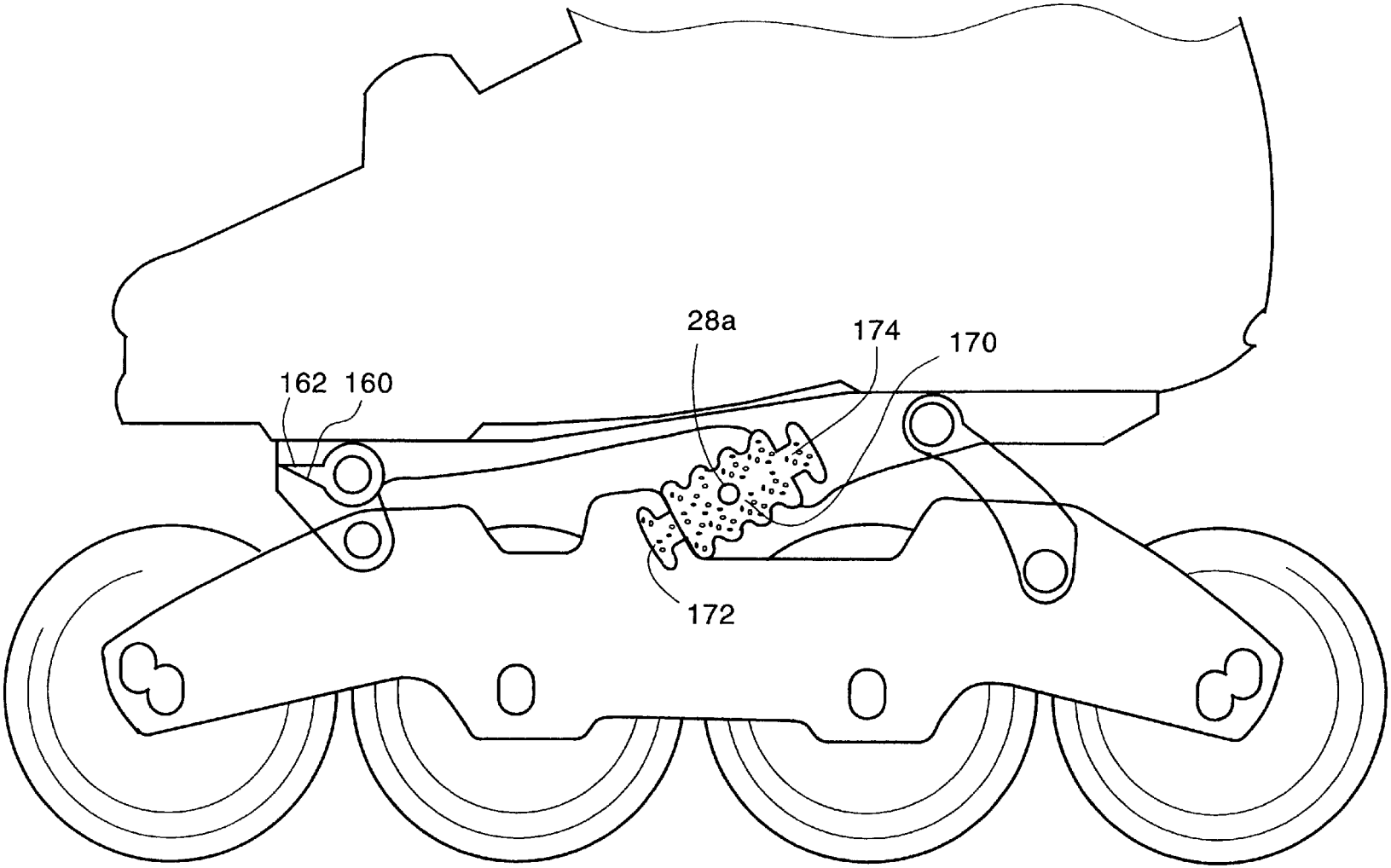
FIG. 4 is a schematic view of another embodiment of the shock absorber subsystem of this invention.

Alternatively, the position of pivot point 20 relative to pivot point 22 could be fixed and not adjustable. Ledge 160 of member 16 cooperates with surface 162 as a stop to prevent forward motion of truck 14 relative to shoe 12. As shown in FIG. 4, shock absorber system 28*a* may simply include resilient member 170 removably fixed in place between truck mount 172 and shoe mount 174. In this design, a cost savings is realized by eliminating the pivots, bushings, and adjustment mechanism.

The distance between pivot shaft 20, FIG. 1, and shaft 24 is approximately 5.6 inches. Resilient member 92 is approximately 1.25 inches long and compressible to about 0.768 inches.

Figure 5:
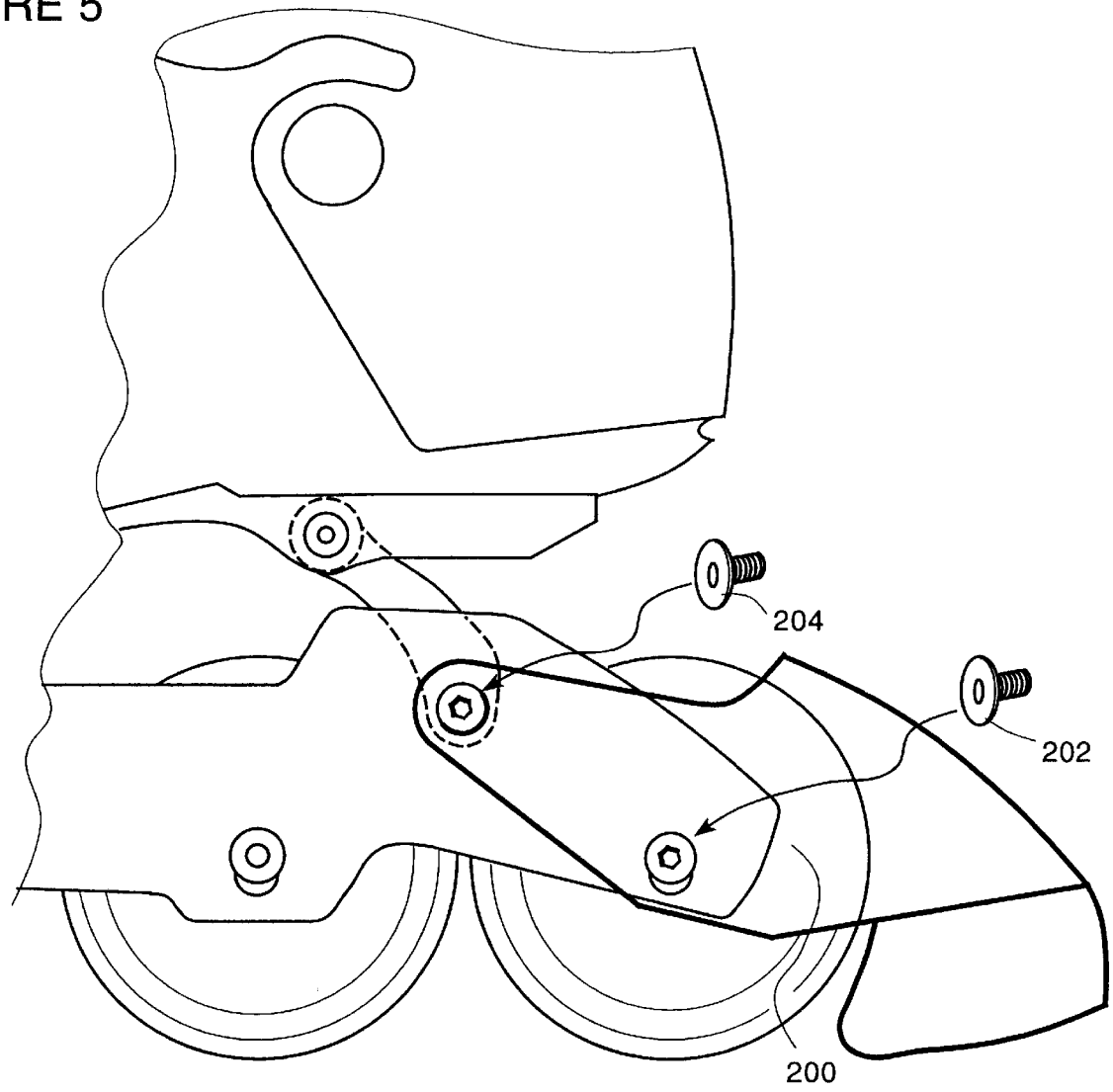
FIG. 5 is a schematic view of the removable brake shoe in accordance with the subject invention.

Another feature of the subject invention is brake shoe 200, FIG. 5 which is removably attached to the rear of the truck as shown via screws 202 and 204 and a set of two additional screws (not shown) on the other side of the truck. Unique to this invention is the ability for the potential purchaser to test the improved shock absorbintg characteristics of the skate in the showroom of the retail outlet by bouncing up and down on his heels. This eliminates the need to "test drive" the skates before purchasing them.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A suspension system for a skate including a shoe and a truck device, the suspension system comprising:

a four bar linkage including:

a forward mount connectable to the shoe, a rearward mount connectable to the shoe, a first double pivot mechanism interconnecting the forward mount with the truck device and including a first member pivotably attached on an upper end to the forward mount and pivotably attached on a lower end to the truck device, a second double pivot mechanism interconnecting the rearward mount with the truck device and including a second member pivotably attached on an upper end to the rearward mount and pivotably attached on a lower end to the truck device;

the truck device being a continuous member interconnecting the lower ends of the first and second members; and means for resiliently biasing the truck device with respect to the shoe.

2. The suspension system of claim 1 in which said first double pivot mechanism includes a member pivotably attached on one end to the forward mount and pivotably attached on the other end to the truck device.

3. The suspension system of claim 1 in which said second double pivot mechanism includes a member pivotably attached on one end to the rearward mount and pivotably attached on the other end to the truck device.

4. The suspension system of claim 1 in which said means for biasing includes a shock absorber subsystem pivotably attached on one end to said truck device and pivotably attached on the other end to the shoe.

5. The suspension system of claim 4 in which said shock absorption system is attached to the shoe via the rearward mount.

6. The suspension system of claim 4 in which said shock absorber subsystem comprises a first shaft pivotably attached to the truck device, a second shaft pivotably attached to the shoe, and a resilient member disposed to bias the position of the first shaft relative to the position of the second shaft.

7. The suspension system of claim 6 in which said resilient member is disposed about said first shaft.

8. The suspension system of claim 6 in which said second shaft includes an orifice for slidably receiving said first shaft.

9. The suspension system of claim 8 in which said second shaft includes an adjustment mechanism for adjusting the position of said first shaft relative to said second shaft.

10. The suspension system of claim 9 in which said adjustment mechanism includes a housing and bolt receivable in the housing.

11. The suspension system of claim 10 in which said housing is pivotably connected to the shoe.

12. The suspension system of claim 11 in which said housing is pivotably connected to the shoe via the rearward mount.

13. The suspension system of claim 10 in which said bolt includes a head engaged with said resilient member for adjusting the resiliency of the resilient member.

14. The suspension system of claim 1 in which said means for biasing includes a shock absorber subsystem pivotably attached on one end to said truck device and pivotably attached on the other end to said shoe, said shock absorber system including:

a resilient member, and means for adjusting the resiliency of the resilient member.

15. The suspension system of claim 14 in which said means for adjusting comprises a first shaft pivotably attached to the truck device and a second shaft pivotably attached to the shoe, the resilient member disposed to bias the position of the first shaft relative to the position of the second shaft.

16. The suspension system of claim 15 in which said resilient member is disposed about said first shaft.

17. The suspension system of claim 15 in which said second shaft includes an orifice for slidably receiving said first shaft.

18. The suspension system of claim 17 in which said second shaft includes an adjustment mechanism for adjusting the position of said first shaft relative to said second shaft.

19. The suspension system of claim 18 in which said adjustment mechanism includes a housing and bolt receivable in the housing.

20. The suspension system of claim 19 in which said housing is pivotably connected to the shoe.

21. The suspension system of claim 20 in which said housing is pivotably connected to the shoe via the rearward mount.

22. The suspension system of claim 19 in which said bolt includes a head engaged with said resilient member for adjusting the resiliency of the resilient member.

23. The suspension system of claim 1 in which said first double pivot mechanism includes first pivot means proximate the forward mount and second pivot means proximate the truck device, said first and second pivot means disposed generally one on top of the other and generally vertically aligned to provide decreased vertical resiliency for the forward push-off portion of the skate.

24. The suspension system of claim 23 further including means for adjusting the vertical alignment of first and second pivot means between 0 and 25°.

25. The suspension system of claim 1 in which said second double pivot mechanism includes third pivot means proximate said rearward mount and fourth pivot means proximate the truck device.

26. The suspension system of claim 25 in which said third and fourth pivot means are disposed generally not one on top of the other and not generally vertically aligned to provide increased vertical resiliency for the rearward shock absorbing portion of the skate.

27. The suspension system of claim 14 further including means for releasably locking the means for simultaneously adjusting.

28. The suspension system of claim 1 in which said means for biasing includes a single shock absorber between the skate shoe and the truck mechanism.

29. The suspension system of claim 1 further including a brake device attached to said truck device.

30. The suspension system of claim 29 in which said brake device is detachable from the truck device.

31. The suspension system of claim 1 in which said forward mount and said rearward mount are portions of a single rigid plate secured to the skate shoe.

32. A suspension system for a skate including a shoe and a truck device, the suspension system comprising:

a four bar linkage including:

a forward mount connectable to the shoe, a rearward mount connectable to the shoe, a first double pivot mechanism including one end connected to the forward mount and another end connected to the truck device, and a second double pivot mechanism including one end connected to the rearward mount and another end connected to the truck device;

the truck device being a continuous member between the first and second double pivot mechanisms; and a shock absorber subsystem pivotably attached on one end to said truck device and pivotably attached on the other end to the shoe.

33. A suspension system for a skate including a shoe and a truck device, the suspension system comprising:

a four bar linkage including:

a forward mount connectable to the shoe;

a rearward mount connectable to the shoe, a first double pivot mechanism interconnecting the forward mount with the truck device, and a second double pivot mechanism interconnecting the rearward mount with the truck device;

a resilient member for biasing truck device with respect to the skate shoe; and means for adjusting the resiliency of the resilient member.

34. A suspension system for a skate including a shoe and a truck device, the suspension system comprising:

a four bar linkage including:

a forward mount on the shoe, a rearward mount on the shoe, a first double pivot mechanism interconnecting the forward mount with the truck device including first pivot means proximate the forward mount and second pivot means proximate the truck device, and a second double pivot mechanism interconnecting the rearward mount with the truck device including third pivot means proximate the rearward mount and fourth pivot means proximate the truck device, the truck device being a continuous member interconnecting the second pivot means with the fourth pivot mean; and means for resiliently biasing the position of the first pivot means with respect to the second pivot means.

35. The suspension system of claim 34 in which said first double pivot mechanism includes a member extending between the forward mount and the truck device, the first pivot means pivotably connecting the member with the forward mount, the second pivot means pivotably connecting the member with the truck device.

36. The suspension system of claim 34 in which said second double pivot mechanism includes a member extending between the rearward mount and the truck device, the third pivot means pivotably connecting the member to the rearward mount, the fourth pivot means pivotably connecting the member to the truck device.

37. The suspension system of claim 34 in which the means for biasing includes a single shock absorber mechanism extending between the shoe and the truck device.

38. The suspension system of claim 37 in which the single shock absorber mechanism includes means for adjusting the stiffness of the shock absorber mechanism.

39. A suspension system comprising:

a four bar linkage including:

a forward mount connectable to a first member, a rearward mount connectable to the first member, a first double pivot mechanism interconnecting the forward mount with a second member, the first double pivot mechanism including a first element pivotably attached on an upper end to the forward mount and pivotably attached on a lower end to the second member, and a second double pivot mechanism interconnecting the rearward mount with the second member, the second double pivot mechanism including a second element pivotably attached on an upper end to the rearward mount and pivotably attached on a lower end to the second member, the second member extending between the lower end of the first element and the lower end of the second element; and means for resiliently biasing the first member with respect to the second member.

40. A suspension system for a skate including a shoe and a truck device, the suspension system comprising:

a four bar linkage including:

a forward mount connectable to the shoe, a rearward mount connectable to the shoe, a first double pivot mechanism interconnecting the forward mount with the truck device, and a second double pivot mechanism interconnecting the rearward mount with the truck device; and means for biasing the truck device with respect to the shoe including a shock absorber subsystem pivotably attached on one end to the truck device and pivotably attached on the other end to the shoe, the shock absorber subsystem comprising a first shaft pivotably attached to the truck device, a second shaft pivotably attached to the shoe, and a resilient member disposed to bias the position of the first shaft relative to the position of the second shaft.

41. A suspension system for a skate including a shoe and a truck device, the suspension system comprising:

a four bar linkage including:

a forward mount connectable to the shoe, a rearward mount connectable to the shoe, a first double pivot mechanism interconnecting the forward mount with the truck device, and a second double pivot mechanism interconnecting the rearward mount with the truck device; and means for biasing the truck device with respect to the shoe including a shock absorber subsystem pivotably attached on one end to the truck device and pivotably attached on the other end to the shoe, the shock absorber system including:

a resilient member, and means for adjusting the resiliency of the resilient member, said means including a first shaft pivotably attached to the truck device and a second shaft pivotably attached to the shoe, the resilient member disposed to bias the position of the first shaft relative to the position of the second shaft.

42. A suspension system for a skate including a shoe and a truck device, the suspension system comprising:

a four bar linkage including:

a forward mount connectable to the shoe, a rearward mount connectable to the shoe, a first double pivot mechanism interconnecting the forward mount with the truck device, and a second double pivot mechanism interconnecting the rearward mount with the truck device, the second double pivot mechanism including third pivot means proximate said rearward mount and fourth pivot means proximate the truck device; and means for resiliently biasing the truck device with respect to the shoe.

43. A suspension system for a skate including a shoe and a truck device, the suspension system comprising:

a four bar linkage including:

a forward mount connectable to the shoe, a rearward mount connectable to the shoe, a first double pivot mechanism interconnecting the forward mount with the truck device, the first double pivot mechanism including first pivot means proximate the forward mount and second pivot means proximate the truck device, said first and second pivot means disposed one on top of the other and are vertically aligned to provide decreased vertical resiliency for the forward push-off portion of the skate, and a second double pivot mechanism interconnecting the rearward mount with the truck device; and means for resiliently biasing the truck device with respect to the shoe.

44. A suspension comprising:

a four bar linkage including:

a forward mount, a rearward mount, a first double pivot mechanism interconnecting the forward mount with a device and including a first singular member pivotably attached on an upper end to the forward mount and pivotably attached on a lower end to the device, a second double pivot mechanism interconnecting the rearward mount with the device and including a second singular member pivotably attached on an upper end to the rearward mount and pivotably attached on a lower end to the device;

the device being a continuous member interconnecting the lower ends of the first and second singular members; and means for resiliently biasing the device with respect to at least one of the forward mount and the rearward mount.

* * * * *